US005783372A

United States Patent [19]

Budz et al.

[11] Patent Number: 5,783,372

[45] Date of Patent: Jul. 21, 1998

[54] DIGITAL IMAGING WITH HIGH CHLORIDE EMULSIONS CONTAINING IODIDE

[75] Inventors: Jerzy Antoni Budz; Jerzy Mydlarz, both of Fairport; Benjamin Teh-Kung Chen, Penfield; James Lawrence Edwards, Rochester, all of N.Y.

[73] Assignee: Eastman Kodak Company, Rochester, N.Y.

[21] Appl. No.: 601,642

[22] Filed: Feb. 14, 1996

Related U.S. Application Data

[60] Provisional application No. 60/000,463 Jun. 23, 1995.

[51] Int. Cl.[6] ..... G03C 1/035; G03C 1/09

[52] U.S. Cl. ..... 430/363; 430/567; 430/945; 430/494; 430/394; 430/603; 430/605

[58] Field of Search ..... 430/567, 363, 430/945, 494, 394, 603, 605

[56] References Cited

U.S. PATENT DOCUMENTS

| | | | |
|---|---|---|---|
| 3,561,971 | 2/1971 | Pestalozzi | 430/604 |
| 4,883,737 | 11/1989 | Yamamoto | 430/138 |
| 4,883,748 | 11/1989 | Hayakawa | 430/567 |
| 4,939,067 | 7/1990 | Takagi et al. | 430/567 |
| 4,945,035 | 7/1990 | Keevert, Jr. et al. | 430/567 |
| 4,983,509 | 1/1991 | Inoue et al. | 430/627 |
| 5,064,753 | 11/1991 | Sohei et al. | 430/567 |
| 5,077,183 | 12/1991 | Reuss et al. | 430/505 |
| 5,079,138 | 1/1992 | Takada | 430/567 |
| 5,227,286 | 7/1993 | Kuno et al. | 430/539 |
| 5,240,827 | 8/1993 | Lewis | 430/603 |
| 5,264,337 | 11/1993 | Maskasky | 430/567 |
| 5,296,343 | 3/1994 | Hioki et al. | 430/508 |
| 5,298,385 | 3/1994 | Chang et al. | 430/567 |
| 5,314,798 | 5/1994 | Brust et al. | 430/567 |
| 5,348,850 | 9/1994 | Yoshida | 430/575 |
| 5,451,490 | 9/1995 | Budz et al. | 430/363 |
| 5,550,013 | 8/1996 | Chen et al. | 430/567 |

FOREIGN PATENT DOCUMENTS

| | | | |
|---|---|---|---|
| 0 543 403 | 5/1993 | European Pat. Off. | G03C 5/50 |

*Primary Examiner*—Mark F. Huff
*Attorney, Agent, or Firm*—Paul A. Leipold

[57] ABSTRACT

The invention relates to a photographic element for digital exposure comprising at least one layer comprising an emulsion of cubic silver iodochloride grain wherein said grain has been sensitized with a gold compound and with less than 1 μmole per silver mole of sulfur.

4 Claims, No Drawings

DIGITAL IMAGING WITH HIGH CHLORIDE EMULSIONS CONTAINING IODIDE

CROSS REFERENCE TO RELATED APPLICATION

Reference is made to and priority claimed from U.S. Provisional application Ser. No. 60/000,463, filed 23 Jun. 1995, entitled DIGITAL IMAGING WITH HIGH CHLORIDE EMULSIONS CONTAINING IODIDE.

FIELD OF THE INVENTION

The invention relates to a photographic element and the method of electronic printing wherein information is recorded in a pixel-by-pixel mode in a radiation sensitive silver halide emulsion layer.

CROSS-REFERENCE TO RELATED PATENT APPLICATIONS

This application is related to the following commonly assigned applications filed previously: IODOCHLORIDE EMULSIONS CONTAINING IODONIUM SALTS HAVING HIGH SENSITIVITY AND LOW FOG of Chen et al, filed Dec. 22, 1994 as U.S. application Ser. No. 361,923 now U.S. Pat. No. 5,605,789; IODOCHLORIDE EMULSIONS CONTAINING QUINONES HAVING HIGH SENSITIVITY AND LOW FOG of Chen et al, filed Dec. 22, 1994 as U.S. application Ser. No. 361,924 now U.S. Pat. No. 5,547,827; HIGH CHLORIDE EMULSION HAVING HIGH SENSITIVITY AND LOW FOG of Chen et al, filed Dec. 22, 1994 as U.S. application Ser. No. 362,107; PHOTOGRAPHIC PRINT ELEMENTS CONTAINING EMULSIONS OF ENHANCED SPEED AND CONTROLLED MINIMUM DENSITIES of Edwards et al, filed Dec. 22, 1994 as U.S. application Ser. No. 362,109 now abandoned; HIGH CHLORIDE EMULSIONS HAVING HIGH SENSITIVITY AND LOW FOG AND IMPROVED PHOTOGRAPHIC RESPONSES OF HIRF, HIGHER GAMMA, AND SHOULDER DENSITY of Chen et al, filed Dec. 22, 1994 as U.S. application Ser. No. 362,110 now U.S. Pat. No. 5,550,013; and CUBICAL SILVER IODOCHLORIDE EMULSIONS PROCESSES FOR THEIR PREPARATION AND PHOTOGRAPHIC PRINT ELEMENTS of Chen et al, filed Dec. 22, 1994 as U.S. application Ser. No. 362,283 now abandoned.

BACKGROUND OF THE INVENTION

Many known imaging systems require that a hard copy be provided from an image which is in digital form. A typical example of such a system is electronic printing of photographic images which involves control of individual pixel exposure. Such a system provides greater flexibility and the opportunity for improved print quality in comparison to optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration exposure in a pixel-by-pixel mode using a suitable source such as a cathode ray tube (CRT), light emitting diode (LED) or laser. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, *The Reproduction of Colour*, Fourth Edition, pages 306–307, (1987).

Silver halide emulsions having high chloride contents, i.e., greater than 50 mole percent chloride based on silver, are known to be very desirable in image-forming systems due to the high solubility of silver chloride which permits short processing times and provides less environmentally polluting effluents. Unfortunately, it is very difficult to provide a high chloride silver halide emulsion having the high sensitivity desired in many image-forming processes. Furthermore, conventional emulsions having high chloride contents exhibit significant losses in sensitivity when they are subjected to high energy, short duration exposures of the type used in electronic printing methods of the type described previously herein. Such sensitivity losses are typically referred to as high intensity reciprocity failure.

It is known that certain tabular grain silver halide emulsions can offer a number of photographic advantages. For example, during the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds and improved image sharpness in both mono- and multi-emulsion layer formats, could be achieved by employing tabular grain emulsions.

While tabular grain emulsions have been advantageously employed in a wide variety of photographic and radiographic applications, the requirement of parallel twin plane formation and {111} crystal faces pose limitations both in emulsion preparation and use. These disadvantages are most in evidence in considering tabular grains containing significant chloride concentrations. It is generally recognized that silver chloride grains prefer to form regular cubic grains—that is, grains bounded by six identical {100} crystal faces. Tabular grains bounded by {111} faces in silver chloride emulsions often revert to nontabular forms unless morphologically stabilized.

Maskasky U.S. Pat. No. 5,264,337 teaches the preparation of silver chloride {100} tabular grains that are internally free of iodide at the site of grain nucleation. Greater than 50% of the grain population projected area is accounted for by {100} tabular grains which have an average aspect ratio of up to 7.5. Maskasky U.S. Pat. No. 5,275,930 discloses chemical sensitization of such grains with the use of bromide corner epitaxy, whereas U.S. Pat. No. 5,264,337 extends the art to preparation of tabular grains of aspect ratios greater than 7.5.

Although {100} silver chloride tabular grains comprise inherently stable <100> faces the preparation of such grains requires the use of organic addenda present during precipitation. A significant advance in the art of {100} silver chloride emulsion preparation was disclosed by House et al in U.S.Pat. No. 5,320,938. A minute amount of iodide used during emulsion nucleation triggered growth of {100} tabular grains without the need for organic growth modifiers. The high chloride {100} tabular grain emulsions of House et al represent an advance in the art in that (1) by reason of higher tabular shape, they achieve the known advantages of tabular grain emulsions over nontabular grain emulsions, (2) by reason of their high chloride content they achieve the known advantages of high chloride emulsions over those of other halide compositions (e.g., low blue native sensitivity, rapid development, and increase ecological compatibility—that is, rapid processing with more dilute developer solutions and rapid fixing with ecologically preferred sulfite ion fixers), and (3) by reason of their {100} crystal faces the tabular grains exhibit higher levels of grain shape stability, allowing the use of morphological stabilizers adsorbed to grain surfaces during emulsion prepartion to be entirely eliminated. A further and surprising advantage of House et al is that the high chloride {100} tabular grain emulsions sensitivity levels can be higher than previously thought possible for high chloride emulsions.

Budz et al U.S. Pat. No. 5,451,490, disclose exceptionally small high intensity reciprocity failure of silver chloride {100} tabular emulsions chemically sensitized with high gold containing chemical sensitization procedures. These emulsions were utilized in digital pixel-by-pixel printing methods.

In order to increase the output of digital printing devices, such as CRT, LED, or laser-based printers, it is highly desirable to increase speed of high chloride silver halide emulsions when exposed at very short times even further. In the art of silver chloride-based color paper preparation it is the blue color record that has the greatest need for speed.

Historically photographic applications requiring higher photographic speeds have been served by employing photographic elements containing silver iodobromide emulsions, since these emulsions can exhibit the most favorable speed-granularity relationships. In search of improving speed-granularity of {100} high chloride tabular emulsions an improvement over existing art was invented by providing {100} high chloride tabular grain emulsions comprising iodide bands incorporated into silver chloride host grains by Brust and Mis U.S. Pat. No. 5,314,798. In one aspect that invention is directed to a radiation sensitive emulsion containing silver halide grain population comprised of at least 50 mole percent chloride, based on silver, wherein at least 50 percent of the grain population projected area is accounted for by tabular grains (1) bounded by {100} major faces having adjacent edge ratios of less than 10 and (2) each having an aspect ratio of at least 2; wherein (3) each of the tabular grains is comprised of a core and a surrounding band containing a higher level of iodide ions. The emulsions of that invention were all optimally sensitized by the customary empirical techniques of varying the level of sensitizing dye, sulfur and gold sensitizers and the hold time at elevated temperature (often referred to as digestion time). Speed advantages due to the use of banded iodide were significant at an exposure time of 0.02 second.

In order to reach for the ultimate efficiency of high chloride emulsions at very short exposure times, as required for digital printing devices, the chemical sensitization procedures, as practiced in U.S. Pat. No. 5,541,490 were combined with iodide banded {100} tabular grains, as disclosed in U.S. Pat. No. 5,314,798 and failed to yield further speed increases.

Silver chloride tabular grain emulsions, whereas superior in many aspects to conventional cubic grain emulsions, are much more difficult to manufacture due to the complex precipitation conditions. Another way to maximize speed of high chloride emulsions is to increase the crystal size of conventional cubic grain emulsion. There is a known effect, however, that with the increase of grain size a deterioration of high intensity reciprocity behavior is observed, thus severely limiting this option.

Kuno U.S. Pat. No. 5,227,286 discloses chlorobromide emulsions for short time exposures. A four-way interaction of gel laydown and silver laydown and high chloride and iridium doping is claimed to improve efficiency of this system using a xenon lamp flash exposure at short exposure time ($10^{-5}$ sec). Conventional sulfur-plus-gold chemical sensitization was used to chemically digest all of the emulsions. The emulsions described in that patent contain ca. 0.05 mol % iodide (introduced at the end of precipitation), but the iodide is not a factor in the claimed combination.

U.S. Pat. No. 4,983,509 is one example of core-shell silver bromoiodide grains which are useful for short time exposures. Whereas mixed bromoiodide emulsions yield good reciprocity and efficiency, they posses a disadvantage of being not suitable for rapid-access, ecologically desired processes.

PROBLEM TO BE SOLVED BY THE INVENTION

In light of the previous discussion, it is evident that there is a need to provide an electronic printing method in which a recording element containing a high chloride silver halide emulsion is subjected to short duration, high energy exposure in a pixel-by-pixel mode that is not subject to the disadvantages discussed such as reciprocity failure.

SUMMARY OF THE INVENTION

An object of this invention is to provide a silver halide photographic element suitable for short duration and high energy exposure.

Another object of the invention is to provide emulsions suitable for use in photographic elements that are intended for short duration digital exposure.

These and other objects of the invention are generally accomplished by providing a photographic element for digital exposure comprising at least one layer comprising an emulsion of cubic silver iodochloride grain wherein said grain has been sensitized with a gold compound and with less than 1 μmole per silver mole of sulfur.

In a preferred embodiment the gold compound comprises 0.10 to 100 milligrams of gold sulfide per mole of silver.

ADVANTAGEOUS EFFECT OF THE INVENTION

The invention provides a low-cost photographic element that can be exposed by short duration, high intensity exposure. Further, the element is generally processable in the development methods presently used for the commercial silver chloride papers.

Another advantage of the invention is that the photographic paper for digital exposure generally is one formed by the technique of the invention, not significantly more expensive than conventional silver chloride color papers for consumer use. These and other advantages of the invention will be apparent from the description below.

DETAILED DESCRIPTION OF THE INVENTION

The photographically useful, short time/high intensity radiation sensitive element of the invention is comprised of at least one radiation sensitive high chloride emulsion wherein each grain of the emulsion contains a band of higher level of iodide.

A feature that distinguishes the high chloride emulsions of this invention from the conventional high chloride emulsions known in the art is the presence of a band containing a higher level of iodide ions. The term "higher iodide band" is used here to describe the situation where the iodide is intentionally added during the grain formation. The higher iodide band is introduced into the grains during precipitation, after grain nucleation and is preferably delayed well into the growth stage of precipitation. Hence the higher iodide band surrounds a core portion of the grain formed during the earlier stages of precipitation.

It is preferred to delay introduction of the iodide band into the crystals until a grain core has been formed that accounts for at least 50 percent of the total silver forming the grains. It is specifically preferred that the core accounts for at least 85 percent of total silver.

It is specifically contemplated to defer formation of the higher iodide band until the end of the precipitation procedure, so that the band either forms or lies adjacent to the exterior portion of the grains. When the higher ioidide band is formed before the completion of precipitation, the band necessarily is located within the grain structure; that is, the band is itself surrounded by a shell. Although the description is generally confined to the grain structure containing a single higher iodide band, with or without a surrounding shell, it is recognized that there is no reason in principle why the grains could not be provided with multiple bands separated by intermediate shells.

As demonstrated in the Examples below, the advantage of the higher iodide band does not lie in the mere elevation of the iodide level, but in the nonuniformity of the iodide distribution within the grain structure. The nonuniformity of the iodide distribution is controlled both by the level of iodide introduced in forming the band and by restricting the proportion of the total grain structure formed by the band.

In the preferred form of invention the iodide band accounts for up to 5 percent of the silver forming the high chloride grains. Optimally the iodide band accounts for up to 2 percent of the silver forming the grain. However, the iodide band can account for a higher proportion (e.g., up to 30 percent) of the silver forming the high chloride grain. For rapid access processes, as used in the art for high chloride emulsions, it is preferred to contain the iodide band to less than 1 percent of the silver forming the grain and most preferably to 0.5% or less of the silver forming the grain.

While it is demonstrated in the Examples below that the higher iodide bands dramatically improve the high intensity reciprocity failure of the emulsions of the invention as compared to high chloride emulsions having more uniform iodide distributions, the mechanism by which reciprocity has been improved is not known with certainty. It can be stated with confidence that the iodide is incorporated into the cubic crystal lattice provided by the silver chloride. The silver chloride lattice is at least strained by the presence of iodide ions, since the iodide ions are much larger than the chloride ions they replace. Hence, there is a possibility, not corroborated that the crystal lattice defects propagate to the grain surface thus providing different substrate for subsequent chemical sensitization reactions. As a consequence of a complex reactions taking place on the crystal surface certain chemical sensitizers (e.g., gold sulfide) may fortuitously provide optimum finishes with improved overall properties (e.g., less reciprocity failure).

While there is no intention to be bound by any particular theory to account for the structure or effectiveness of the emulsion of the invention, these considerations led to certain preferences. During band formation it is preferred to introduce the iodide ions into the grains in a manner that enhances the opportunity for crystal lattice imperfections or strains. Thus, the iodide introduced during band formation is preferably abruptly introduced at the maximum achievable introduction rate. This is commonly referred to as an iodide dump. The iodide is preferably introduced as a soluble salt (e.g., alkali, alkaline earth, or ammonium iodide) with or without the concurrent introduction of silver ion salts. The introduction of high iodide Lippmann emulsion during band formation is an art recognized alternative to the double-jet addition of silver and halide ions, and this approach is contemplated, but not preferred.

The invention may be practiced with any of the known techniques for emulsion preparation. Such .techniques include those which are normally utilized, for instance single jet or double jet precipitation; or they may include forming a silver halide emulsion by the nucleation of silver halide grains in a separate mixer or first container with later growth in a second container. All these techniques are referenced in the patents discussed in *Research Disclosure*, December 1989, 308119, Sections I–IV at pages 993–1000. Specifically high chloride tabular emulsions containig {100} crystal faces may be precipitated as described in U.S. Pat. No. 5,320,983.

The dispersing medium contained in the reaction vessel prior to the nucleation step is comprised of water, the dissolved chloride ions and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., <7.0). To minimize fog a preferred pH range for precipitation is from 2.0 to 5.0. Mineral acids, such as nitric acid or hydrochloric acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire P010 7DD, England. While synthetic polymeric peptizers of the type disclosed by Maskasky U.S. Pat. No. 4,400,463, can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer. These peptizers and their preparation are described by Maskasky U.S. Pat. No. 4,713,323 and King et al U.S. Pat. No. 4,942,120. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete; however, low levels of methionine (as in oxidized gelatins) is preferred.

The nucleation step can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

It is usually preferred to prepare photographic emulsions with the most geometrically uniform grain populations attainable, since this allows a higher percentage of the grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

If desired, the ripening can be introduced by the presence of a ripening agent in the emulsion during precipitation. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be effected by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective.

During the growth step both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Patent 3,672,900, Saito U.S. Pat. No. 4,242,445, Teitschied et al European Patent Application 80102242, and Wey "Growth Mechanism of AgBr Crystals in Gelatin Solution", *Photographic Science and Engineering*, Vol. 21, No. 1, Jan./Feb. 1977, p. 14, et seq.

In the simplest form of the grain preparation the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described herein. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326,852, 326,853, 355,535 and 370,116, Ichizo published European Patent Application 0 368 275, Urabe et al published European Patent Application 0 374 954, and Onishi et al published Japanese Patent Application (Kokai) 172,817-A (1990).

The emulsions used in the recording elements are silver iodochloride emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium rhenium, and Group VIII metals (e.g., iron, ruthenium, rhodium, palladium, osmium, iridium, and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

The high chloride emulsions of the invention are chemically sensitized with sulfur and gold at pAg levels of from 5 to 10, pH levels of from 5 to 8 and temperatures of from 30° to 80° C., as illustrated by *Research Disclosure*, Vol. 120, April, 1974, Item 12008, *Research Disclosure*, Vol. 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696 and Deaton U.S. Pat. No. 5,049,485; the amount of the sulfur sensitizer can be properly selected according to conditions such as grain size, chemical sensitization temperature, pAg, and pH; chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714. Sulfur plus gold sensitization of high chloride emulsion is also a subject matter of Mucke et al U.S. Pat. No. 4,906,558. However, for the emulsions of this invention high gold finishes are used, especially when the source of gold sensitizer is a colloidal dispersion of gold sulfide. Other sources of gold can be any useful sources, as practiced in the art, for example as described in Deaton U.S. Pat. No. 5,049,485. The preferred high gold sensitization means that the amount of sulfur sensitizer should be less than 1 μmole per silver mole, and preferably less than 0.5 pmole per silver mole of the sensitized emulsion, whereas the gold compound comprises 0.10 to 100 milligrams of gold sulfide per mole of silver. The optimal amount of sulfur is between 0.5 and 0.05 μmole per silver mole of the sensitized emulsion.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan, cited above, the chemical sensitizers can be added prior to or concurrently with the additional silver halide formation. Chemical sensitization can take place during or after halide conversion as described by Hiasebe et al European Patent Application EP 273,404. In many instances epitaxial deposition onto selected tabular grain sites (e.g., edges or corners) can either be used to direct chemical sensitization or to itself perform the functions normally performed by chemical sensitization.

The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclo-hexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. An example of a material which is sensitive in the infrared spectrum is shown in Simpson et al., U.S. Pat. No. 4,619,892, which describes a material which produces cyan, magenta and yellow dyes as a function of exposure in three regions of the infrared spectrum (sometimes referred to as "false" sensitization). Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions described herein are those found in U.K. Patent 742,112, Brooker U.S. Pat. No. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Of particular importance are also amide, pyrrole, and furan substituted sensitizing dyes that afford reduced dye stain and short blue sensitizing dyes for color paper applications, as disclosed in *Research Disclosure*, Vol. 362, 1994, Item 36216, Page 291. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Some amounts of spectral sensitizing dyes may remain in the emulsion layers after processing causing, what is known in the art, dye stain. Specifically designed for low stain dyes are disclosed in *Research Disclosure*, Vol. 362, 1994, Item 36216, Page 291.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

After sensitizing, the emulsion can be combined with any suitable coupler (whether two or four equivalent) and/or coupler dispersants to make the desired color film or print photographic materials; or they can be used in black and white photographic films and print material. Couplers which can be used in accordance with the invention are described in *Research Disclosure*, Vol. 176, 1978, Section 17643VIII, *Research Disclosure* 308119 Section VII, and in particular in *Research Disclosure*, Vol. 370, 1995, Item 37038.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions used in this invention can also be used in developers and can be classified under a few general headings, as illustrated by C. E. K. Mees, *The Theory of the Photographic Process*, 2nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure*, Vol. 134, June, 1975, Item 13452, and Vol. 148, August, 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure*, Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure*, Item 11684, cited above; purines as illustrated by Sheppard et al U.S. Pat. No. 2,319,090, Birr et al U.S. Pat. No. 2,152,460, *Research Disclosure*, Item 13452, cited above, and Dostes et al French Patent 2,296,204, polymers of 1,3-dihydroxy(and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917. In addition pH adjustment of emulsion prior to coating increases its stability. The usual range of useful pH, as known in the art lies between 4 and 7.

In their simplest form photographic elements of the invention employ a single silver halide emulsion layer containing iodide-banded high chloride emulsions and a support. It is, of course, recognized that more than one such silver halide emulsion layer can be usefully included. Where more than one emulsion layer is used, e.g., two emulsion layers, all such layers can be iodide-banded high chloride emulsions layers. However, the use of one or more conventional silver halide emulsion layers, including tabular grain emulsion layers, in combination with one or more iodide-banded high chloride emulsion layers is specifically contemplated. It is also specifically contemplated to blend the iodide-banded high chloride emulsions of the present invention with each other or with conventional emulsions to satisfy specific emulsion layer requirements. Instead of blending emulsions, the same effect can usually be achieved by coating the emulsions to be blended as separate layers in an emulsion unit. For example, coating of separate emulsion layers to achieve exposure latitude is well known in the art. It is further well known in the art that increased photographic speed can be realized when faster and slower silver halide emulsions are coated in separate layers. Typically the faster emulsion layer in an emulsion unit is coated to lie nearer the exposing radiation source than the slower emulsion layer. Coating the faster and slower emulsions in the reverse layer order can change the contrast obtained. This approach can be extended to three or more superimposed emulsion layers in an emulsion unit. Such layer arrangements are specifically contemplated in the practice of this invention.

The recording elements used in this invention can contain brighteners (Section V), antifoggants and stabilizers (Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in *Research Disclosure*, December 1989, Item 308119.

The recording elements used in this invention can be coated on a variety of supports, as described in Section XVII of *Research Disclosure*, December 1989, Item 308119, and references cited therein.

The recording elements used in this invention can be exposed to actinic radiation in a pixel-by-pixel mode as more fully described hereinafter to form a latent image and then processed to form a visible image, as described in Sections XVIII and XIX of *Research Disclosure*, December 1989, Item 308119. Typically, processing to form a visible dye image includes the step of contacting the recording element with a color developing agent to reduce developable silver halide and oxidize the color developing agent. Oxidized color developing agent in turn reacts with the coupler to yield a dye. Preferred color developing agents are p-phenylenediamines. Especially preferred are 4-amino-3-methyl-N,N-diethylaniline hydrochloride, 4-amino-3-methyl-N-ethyl-N-(methanesulfonamido)ethylaniline sulfate hydrate, 4-amino-3-methyl-N-ethyl-N-hydroxyethylaniline sulfate, 4-amino-3-(methanesulfonamido)ethyl-N,N-diethylaniline hydrochloride, and 4-amino-N-ethyl-N-(2-methoxyethyl)m-toluidine di-p-toluenesulfonic acid.

With negative-working silver halide, the processing step described hereinbefore provides a negative image. The described elements can be processed in the color paper process Kodak Ektacolor RA-4 or Kodak Flexicolor color process as described in, for example, the British Journal of Photography Annual of 1988, pages 196–198. To provide a positive (or reversal) image, the color development step can be preceded by development with a non-chromogenic developing agent to develop exposed silver halide but not form dye, and then uniform fogging of the element to render unexposed silver halide developable. The Kodak E-6 Process is a typical reversal process. Development is followed by the conventional steps of bleaching, fixing, or bleach-fixing, to remove silver or silver halide, washing, and drying.

The described elements can be also processed in the ionic separation imaging systems which utilize the sulfonamidonaphtol diffusion transfer technology. Such a photographic product comprises at least one image dye providing element comprising at least one layer of photosensitive silver halide emulsion with which is associated a non-diffusible image dye-providing substance. After image-wise exposure, a coating is treated with an alkaline processing composition in the presence of a silver halide developing agent in such a way that for each dye-image forming element, a silver image is developed. An image-wise distribution of oxidized developer cross-oxidizes the molecule of the image dye-providing compound. This, in an alkaline medium, cleaves to liberate a diffusible image dye. A preferred system of this type is disclosed in published in Fleckenstein U.S. trial voluntary protest document B351,637, dated Jan. 28, 1975. Other patents include: U.S. Pat. Nos. 4,450,224 and 4,463,080, and U.K. Patents 2,026,710 and 2,038,041.

In a similar technology, a silver halide photographic process is combined with LED exposure and thermal development/transfer resulting in a high image quality hard copy system incorporating digital exposure technology. Some of the many patents include U.S. Pat. Nos. 4,904,573; 4,952,969; 4,732,846; 4,775,613; 4,439,513; 4,473,631; 4,603,103; 4,500,626; 4,713,319 (Fujix Pictography).

The recording elements comprising the radiation sensitive iodide-banded high chloride emulsion layers according to this invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum, as well as electron-beam radiation, and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source need, of course, provide radiation in only one spectral region if the recording element is a monochrome element sensitive to only that region (color) of the electromagnetic spectrum. Suitable light emitting diodes and commercially available laser sources are described in the examples. Imagewise exposures at ambient, elevated or reduced temperatures and/or pressures can be employed within the useful response range of the recording element determined by conventional sensitometric techniques, as illustrated by T. H. James, *The Theory of the Photographic Process*, 4th Ed., Macmillan, 1977, Chapters 4, 6, 17, 18 and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^3$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100 microseconds, often up to 10 microseconds, and frequently up to only 0.5 microsecond. As illustrated by the following Examples, excellent results are achieved with a laser beam at an exposure time of only 0.05 microsecond, and still lower exposure times down to 0.01 microsecond are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1, the disclosures of which are hereby incorporated herein by reference.

A suitable multicolor, multilayer format for a recording element used in the electronic printing method of this invention is represented by Structure I.

| STRUCTURE I |
|---|
| Blue-sensitized<br>yellow dye image-forming silver halide emulsion unit |
| Interlayer |
| Green-sensitized<br>magenta dye image-forming silver halide emulsion unit |
| Interlayer |
| Red-sensitized<br>cyan dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are typically separated from each other by interlayers, as shown.

In the practice of the present invention, an iodide-banded silver chloride emulsion in reactive association with a dye image-forming compound can be contained in the blue-sensitized silver halide emulsion unit only, or it can be contained in each of the silver halide emulsion units.

Another useful multicolor, multilayer format for an element of the invention is the so-called inverted layer order represented by Structure II.

| STRUCTURE II |
|---|
| Green-sensitized<br>magenta dye image-forming silver halide emulsion unit |
| Interlayer |
| Red-sensitized<br>cyan dye image-forming silver halide emulsion unit |
| Interlayer |
| Blue-sensitized<br>yellow dye image-forming silver halide emulsion unit |
| ///// Support ///// |

wherein the blue-sensitized, yellow dye image-forming silver halide unit is situated nearest the support, followed next by the red-sensitized, cyan dye image-forming unit, and uppermost the green-sensitized, magenta dye image-forming unit. As shown, the individual units are typically separated from one another by interlayers.

As described above for Structure I, an iodide-banded silver chloride emulsion can be located in the blue-sensitized silver halide emulsion unit, or it can be in each of the units.

Still another suitable multicolor, multilayer format for an element of the invention is illustrated by Structure III.

| STRUCTURE III |
|---|
| Red-sensitized<br>cyan dye image-forming silver halide emulsion unit |
| Interlayer |
| Green-sensitized<br>magenta dye image-forming silver halide emulsion unit |
| Interlayer |
| Blue-sensitized<br>yellow dye image-forming silver halide emulsion unit |
| ///// Support ///// |

wherein the blue-sensitized, yellow dye image-forming silver halide unit is situated nearest the support, followed next by the green-sensitized, magenta dye image-forming unit, and uppermost the red-sensitized, cyan dye image-forming unit. As shown, the individual units are typically separated from one another by interlayers.

As described above for Structures I and II, an iodide-banded silver chloride emulsion can be located in the blue-sensitized silver halide emulsion unit, or it can be in each of the units.

Three additional useful multicolor, multilayer formats are represented by Structures IV, V, and VI.

| STRUCTURE IV |
|---|
| $IR^1$ - sensitized<br>yellow dye image-forming silver halide emulsion unit |
| Interlayer |
| $IR^2$ - sensitized<br>magenta dye image-forming silver halide emulsion unit<br>Interlayer |

-continued

| STRUCTURE IV |
|---|
| $IR^3$ - sensitized cyan dye image-forming silver halide emulsion unit |
| ///// Support ///// |

| STRUCTURE V |
|---|
| $IR^1$ - sensitized magenta dye image-forming silver halide emulsion unit |
| Interlayer |
| $IR^2$ - sensitized cyan dye image-forming silver halide emulsion unit |
| Interlayer |
| $IR^3$ - sensitized yellow dye image-forming silver halide emulsion unit |
| ///// Support ///// |

| STRUCTURE VI |
|---|
| $IR^1$ - sensitized cyan dye image-forming silver halide emulsion unit |
| Interlayer |
| $IR^2$ - sensitized magenta dye image-forming silver halide emulsion unit |
| Interlayer |
| $IR^3$ - sensitized yellow dye image-forming silver halide emulsion unit |
| ///// Support ///// |

Structures IV, V, and VI are analogous to the above-described Structures I, II and III, respectively, except that the three emulsion units are sensitized to different regions of the infrared (IR) spectrum. Alternatively, only one or two of the emulsion units in Structures IV, V, and VI may be IR-sensitized, the remaining unit(s) being sensitized in the visible. As with Structures I, II, and III, Structures IV, V, and VI may contain an iodide-banded silver chloride emulsion in the uppermost silver halide emulsion unit, or in the lowermost emulsion unit, or in each of the silver halide emulsion units. Also, as previously discussed, the emulsion units of Structures I–VI can individually comprise a multiplicity of silver halide emulsion layers of differing sensitivity and grain morphology.

EXAMPLES

The invention can be better appreciated by reference to the following Examples. Emulsion Examples A through AD illustrate the preparation of radiation sensitive high chloride emulsions, both for comparison and inventive emulsions. The term "low methionine gelatin" is employed, except as otherwise indicated, to designate gelatin that has been treated with an oxidizing agent to reduce its methionine content to less than 30 micromoles per gram. Examples 1 through 7 illustrate that recording elements containing layers of such emulsions exhibit characteristics which make them particularly useful in electronic printing methods of the type described herein.

EMULSION PRECIPITATIONS

Emulsion A

This emulsion demonstrates a high chloride {100} tabular grain emulsion prepared using iodide only during nucleation. The final halide composition was 99.94 mole percent chloride and 0.06 mole percent iodide, based on silver.

A 4500 mL solution containing 3.5 percent by weight of low methionine gelatin, 0.0056 mole/L of sodium chloride and $3.4\times10^{-4}$ mole/L of potassium iodide was provided in a stirred reaction vessel. The contents of the reaction vessel were maintained at 40° C., and the pCl was 2.25.

While this solution was vigorously stirred, 90 ml of 2.0M silver nitrate solution and 90 mL of a 1.99M sodium chloride were added simultaneously at a rate of 180 mL/min each.

The mixture was then held for 3 minutes, the temperature remaining at 40° C. Following the hold, a 0.5M silver nitrate solution and a 0.5M sodium chloride solution were added simultaneously at 24 mL/min for 40 minutes, the pCl being maintained at 2.25. The silver nitrate solution contained 0.08 mg mercuric chloride per mole of silver. The 0.5M silver nitrate solution and the 0.5M sodium chloride solution were then added simultaneously with a ramped linearly increasing flow from 24 mL/min to 37.1 mL/min over 70 minutes, the pCl being maintained at 2.25 followed by another 70 minutes addition of 0.75M reactants at 37.1 mL/min. Then the temperature was ramped up to 50° C. over 8 minutes at the same reactant addition rate. Then emulsion was held at this temperature for the next 35 minutes. Finally, 0.75M silver nitrate solution and 0.75M sodium chloride solution were added at constant rate of 37.1 mL/min over 12 minutes, the pCl being maintained at 2.0. The emulsion was then washed using an ultrafiltration unit, and its final pH and pCl were adjusted to 5.5 and 1.8, respectively.

The resulting emulsion was a tabular grain silver iodochloride emulsion containing 0.06 mole percent iodide, based on silver. More than 50 percent of total grain projected area was provided by tabular grains having {100} major faces with an average ECD of 1.7 μm and an average thickness of 0.14 μm.

Emulsion B

This emulsion demonstrates a high chloride {100} tabular grain emulsion prepared using iodide during nucleation and additional iodide dump at later stages of precipitation. The final halide composition was 99.84 mole percent chloride and 0.16 mole percent iodide, based on silver.

A 4500 mL solution containing 3.5 percent by weight of low methionine gelatin, 0.0056 mol/L of sodium chloride and $3.4\times10^{-4}$ mol/L of potassium iodide was provided in a stirred reaction vessel. The contents of the reaction vessel were maintained at 40° C., and the pCl was 2.25.

While this solution was vigorously stirred, 90 ml of 2.0M silver nitrate solution and 90 mL of a 1.99M sodium chloride were added simultaneously at a rate of 180 mL/min each.

The mixture was then held for 3 minutes, the temperature remaining at 40° C. Following the hold, a 0.5M silver nitrate solution and a 0.5M sodium chloride solution were added simultaneously at 24 mL/min for 40 minutes, the pCl being maintained at 2.25. The silver nitrate solution contained 0.08 mg mercuric chloride per mole of silver. The 0.5M silver nitrate solution and the 0.5M sodium chloride solution were then added simultaneously with a ramped linearly increasing flow from 24 mL/min to 37.1 mL/min over 70 minutes, the pCl being maintained at 2.25 followed by another 70 minutes addition of 0.75M reactants at 37.1 mL/min. Then the temperature was ramped up to 50° C. over 8 minutes at the same reactant addition rate. Then emulsion was held at this temperature for the next 20 minutes. Then 500 mL of solution containg potassium iodide in an amount corresponding to 0.1 mol percent of total silver precipitated was dumped into the reactor, followed by 15 minutes hold. Finally, 0.75M silver nitrate solution and 0.75M sodium chloride solution were added at constant rate of 37.1 mL/min over 12 minutes, the pCl being maintained at 2.0. The emulsion was then washed using an ultrafiltration unit, and its final pH and pCl were adjusted to 5.5 and 1.8, respectively.

The resulting emulsion was a tabular grain silver iodochloride emulsion containing 0.06 mole percent iodide, based on silver. More than 50 percent of total grain projected area was provided by tabular grains having {100} major faces with an average ECD of 1.7 μm and an average thickness of 0.14 μm.

Emulsion C

This emulsion demonstrates a high chloride {100} tabular grain emulsion prepared using iodide during nucleation and additional iodide dump at later stages of precipitation. The final halide composition was 99.74 mole percent chloride and 0.26 mole percent iodide, based on silver.

A 4500 mL solution containing 3.5 percent by weight of low methionine gelatin, 0.0056 mol/L of sodium chloride and $3.4\times10^{-4}$ mol/L of potassium iodide was provided in a stirred reaction vessel. The contents of the reaction vessel were maintained at 40° C., and the pCl was 2.25.

While this solution was vigorously stirred, 90 ml of 2.0M silver nitrate solution and 90 mL of a 1.99M sodium chloride were added simultaneously at a rate of 180 mL/min each.

The mixture was then held for 3 minutes, the temperature remaining at 40° C. Following the hold, a 0.5M silver nitrate solution and a 0.5M sodium chloride solution were added simultaneously at 24 mL/min for 40 minutes, the pCl being maintained at 2.25. The silver nitrate solution contained 0.08 mg mercuric chloride per mole of silver. The 0.5M silver nitrate solution and the 0.5M sodium chloride solution were then added simultaneously with a ramped linearly increasing flow from 24 mL/min to 37.1 mL/min over 70 minutes, the pCl being maintained at 2.25 followed by another 70 minutes addition of 0.75M reactants at 37.1 mL/min. Then the temperature was ramped up to 50° C. over 8 minutes at the same reactant addition rate. Then emulsion was held at this temperature for the next 20 minutes. Then 500 mL of solution containg potassium iodide in an amount corresponding to 0.2 mol percent of total silver precipitated was dumped into the reactor, followed by 15 minutes hold. Finally, 0.75M silver nitrate solution and 0.75M sodium chloride solution were added at constant rate of 37.1 mL/min over 12 minutes, the pCl being maintained at 2.0. The emulsion was then washed using an ultrafiltration unit, and its final pH and pCl were adjusted to 5.5 and 1.8, respectively.

The resulting emulsion was a tabular grain silver iodochloride emulsion containing 0.06 mole percent iodide, based on silver. More than 50 percent of total grain projected area was provided by tabular grains having {100} major faces with an average ECD of 1.7 μm and an average thickness of 0.14 μm.

Emulsion D

This emulsion demonstrates a high chloride {100} tabular grain emulsion prepared using iodide during nucleation and additional iodide dump at later stages of precipitation. The final halide composition was 99.64 mole percent chloride and 0.36 mole percent iodide, based on silver.

A 4500 mL solution containing 3.5 percent by weight of low methionine gelatin, 0.0056 mol/L of sodium chloride and $3.4\times10^{-4}$ mol/L of potassium iodide was provided in a stirred reaction vessel. The contents of the reaction vessel were maintained at 40° C., and the pCl was 2.25.

While this solution was vigorously stirred, 90 ml of 2.0M silver nitrate solution and 90 mL of a 1.99M sodium chloride were added simultaneously at a rate of 180 mL/min each.

The mixture was then held for 3 minutes, the temperature remaining at 400C. Following the hold, a 0.5M silver nitrate solution and a 0.5M sodium chloride solution were added simultaneously at 24 mL/min for 40 minutes, the pCl being maintained at 2.25. The silver nitrate solution contained 0.08 mg mercuric chloride per mole of silver. The 0.5M silver nitrate solution and the 0.5M sodium chloride solution were then added simultaneously with a ramped linearly increasing flow from 24 mL/min to 37.1 mL/min over 70 minutes, the pCl being maintained at 2.25 followed by another 70 minutes addition of 0.75M reactants at 37.1 mL/min. Then the temperature was ramped up to 50° C. over 8 minutes at the same reactant addition rate. Then emulsion was held at this temperature for the next 20 minutes. Then 500 mL of solution containg potassium iodide in an amount corresponding to 0.3 mol percent of total silver precipitated was dumped into the reactor, followed by 15 minutes hold. Finally, 0.75M silver nitrate solution and 0.75M sodium chloride solution were added at constant rate of 37.1 mL/min over 12 minutes, the pCl being maintained at 2.0. The emulsion was then washed using an ultrafiltration unit, and its final pH and pCl were adjusted to 5.5 and 1.8, respectively.

The resulting emulsion was a tabular grain silver iodochloride emulsion containing 0.06 mole percent iodide, based on silver. More than 50 percent of total grain projected area was provided by tabular grains having {100} major faces with an average ECD of 1.7 μm and an average thickness of 0.14 μm.

Emulsion E

This emulsion demonstrates a high chloride {100} tabular grain emulsion prepared using iodide during nucleation and additional iodide dump at later stages of precipitation. In this emulsion iodide was added with co-current addition of silver and chloride salts in the reactor. The final halide composition was 99.64 mole percent chloride and 0.36 mole percent iodide, based on silver.

A 4500 mL solution containing 3.5 percent by weight of low methionine gelatin, 0.0056 mol/L of sodium chloride and $3.4\times10^{-4}$ mol/L of potassium iodide was provided in a stirred reaction vessel. The contents of the reaction vessel were maintained at 40° C., and the pCl was 2.25.

While this solution was vigorously stirred, 90 ml of 2.0M silver nitrate solution and 90 mL of a 1.99M sodium chloride were added simultaneously at a rate of 180 mL/min each.

The mixture was then held for 3 minutes, the temperature remaining at 40° C. Following the hold, a 0.5M silver nitrate solution and a 0.5M sodium chloride solution were added simultaneously at 24 mL/min for 40 minutes, the pCl being maintained at 2.25. The silver nitrate solution contained 0.08 mg mercuric chloride per mole of silver. The 0.5M silver nitrate solution and the 0.5M sodium chloride solution were then added simultaneously with a ramped linearly increasing flow from 24 mL/min to 37.1 mL/min over 70 minutes, the pCl being maintained at 2:25 followed by another 70 minutes addition of 0.75M reactants at 37.1 mL/min. Then the temperature was ramped up to 50° C. over 8 minutes at the same reactant addition rate. Then emulsion was held at this temperature for the next 20 minutes. Then 500 mL of solution containg potassium iodide in an amount corresponding to 0.3 mol percent of total silver precipitated was dumped into the reactor at the start of the final addition of 0.75M silver nitrate solution and 0.75M sodium chloride solutions at constant rate of 37.1 mL/min over 12 minutes, the pCl being maintained at 2.0. The emulsion was then washed using an ultrafiltration unit, and its final pH and pCl were adjusted to 5.5 and 1.8, respectively.

The resulting emulsion was a tabular grain silver iodochloride emulsion containing 0.06 mole percent iodide, based on silver. More than 50 percent of total grain projected area was provided by tabular grains having {100} major faces with an average ECD of 1.7 μm and an average thickness of 0.14 μm.

Emulsion F

This emulsion demonstrates the conventional, cubic grain emulsion precipitated in oxidized gelatin and containing no intentionally added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion G

This emulsion demonstrates the conventional, cubic grain emulsion precipitated in oxidized gelatin and containing 0.05 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 89 mole percent of total silver was precipitated 2000 mL of solution containing potassium iodide in an amount corresponding to 0.05 mole percent of total silver precipitated was dumped to the reactor. Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion H

This emulsion demonstrates the conventional, cubic grain emulsion precipitated in oxidized gelatin and containing 0.2 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 89 mole percent of total silver was precipitated 2000 mL of solution containing potassium iodide in an amount corresponding to 0.2 mole percent of total silver precipitated was dumped to the reactor. Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion I (Invention)

This emulsion demonstrates the conventional, cubic grain emulsion precipitated in oxidized gelatin and containing 0.5 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 89 mole percent of total silver was precipitated 2000 mL of solution containing potassium iodide in an amount corresponding to 0.5 mole percent of total silver precipitated was dumped to the reactor. Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion J (Invention)

This emulsion demonstrates the conventional, cubic grain emulsion precipitated in oxidized gelatin and containing 0.2 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 92 mole percent of total silver was precipitated 2000 mL of solution containing potassium iodide in an amount corresponding to 0.2 mole percent of total silver precipitated was dumped to the reactor. Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion K (Invention)

This emulsion demonstrates the conventional, cubic grain emulsion precipitated in oxidized gelatin and containing 0.5 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 92 mole percent of total silver was precipitated 2000 mL of solution containing potassium iodide in an amount corresponding to 0.5 mole percent of total silver precipitated was dumped to the reactor. Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion L (Invention)

This emulsion demonstrates the conventional, cubic grain emulsion precipitated in oxidized gelatin and containing 0.2 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 95 mole percent of total silver was precipitated 2000 mL of solution containing potassium iodide in an amount corresponding to 0.2 mole percent of total silver precipitated was dumped to the reactor. Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion M (Invention)

This emulsion demonstrates the conventional, cubic grain emulsion precipitated in oxidized gelatin and containing 0.5 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 95 mole percent of total silver was precipitated 2000 mL of solution containing potassium iodide in an amount corresponding to 0.5 mole percent of total silver precipitated was dumped to the reactor. Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion N

This emulsion demonstrates the conventional, cubic grain emulsion precipitated in oxidized gelatin and containing 0.1 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 90 mole percent of total silver was precipitated salt solution was switched to the one containing sodium chloride mixed with an amount of potassium iodide corresponding to 0.1 mole percent of total silver precipitated. Such a procedure is customarily referred to as "iodide run". Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion O

This emulsion demonstrates the conventional, cubic grain emulsion precipitated in oxidized gelatin and containing 0.2 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 90 mole percent of total silver was precipitated salt solution was switched to the one containing sodium chloride mixed with an amount of potassium iodide corresponding to 0.2 mole percent of total silver precipitated. Such a procedure is customarily referred to as "iodide run". Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion P

This emulsion demonstrates the conventional, cubic grain emulsion precipitated in oxidized gelatin and containing 0.3 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 90 mole percent of total silver was precipitated salt solution was switched to the one containing sodium chloride mixed with an amount of potassium iodide corresponding to 0.3 mole percent of total silver precipitated. Such a procedure is customarily referred to as "iodide run". Total precipitation time of 49 minutes yielded cubic shaped grains of 0.60 μm in edgelength size. The emulsion was then washed using an ultrafiltration unit, and its final pH and pCl were adjusted to 5.5 and 1.8, respectively.

Emulsion O (Invention)

This emulsion demonstrates the conventional, cubic grain emulsion precipitated in non-oxidized gelatin and containing 0.3 mole percent of added iodide.

A pure chloride silver halide emulsion was precipitated by equimolar addition of silver nitrate and sodium chloride solution into a well-stirred reactor containing gelatin peptizer and thioether ripener. Silver nitrate solution contained 0.08 mg mercuric chloride based on silver. After 93 mole percent of total silver was precipitated 200 mL of solution containing potassium iodide in an amount corresponding to 0.5 mole percent of total silver precipitated was dumped to the reactor. Total precipitation time of 37 minutes yielded cubic shaped grains of 0.74 pm in edgelength size. The emulsion was then washed using an ultrafiltration unit, and its final pH and pCl were adjusted to 5.5 and 1.8, respectively.

Emulsion R

This emulsion demonstrates the conventional, large grain cubic emulsion precipitated in non-oxidized gelatin and containing no intentionally added iodide.

A pure chloride silver halide emulsion was precipitated in a manner identical as Emulsion Q, except no iodide was added and precipitation time was extended in order to obtain cubic grains of 1.0 μm in edgelength size. The emulsion was then washed using an ultrafiltration unit, and its final pH and pCl were adjusted to 5.5 and 1.8, respectively.

Emulsion S

This emulsion demonstrates the conventional, large grain cubic emulsion precipitated in non-oxidized gelatin and containing no intentionally added iodide.

A pure chloride silver halide emulsion was precipitated in a manner identical as Emulsion Q, except no iodide was added and precipitation. Small amounts of dicesium pentachloronitrosyl osmate were added during precipitation for emulsion contrast control. Cubic grains of 0.75 μm in edgelength size were obtained. The emulsion was then washed using an ultrafiltration unit, and its final pH and pCl were adjusted to 5.5 and 1.8, respectively.

Emulsion T

This emulsion demonstrates the conventional, cubic grain emulsion precipitated in oxidized gelatin and containing no intentionally added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. Total precipitation time of 61 minutes yielded cubic shaped grains of 0.74 μm in edgelength size. The emulsion was then washed using an ultrafiltration unit, and its final pH and pCl were adjusted to 5.5 and 1.8, respectively.

Emulsion U (Invention)

This emulsion demonstrates the conventional, undoped cubic grain emulsion precipitated in oxidized gelatin and containing 0.2 mole percent of added iodide.

A pure chloride silver halide emulsion was precipitated by equimolar addition of silver nitrate and sodium chloride solution into a well-stirred reactor containing low methionine gelatin peptizer. After 92 mole percent of total silver was precipitated 500 mL of solution containing potassium iodide in an amount corresponding to 0.2 mole percent of total silver precipitated was dumped to the reactor. Total precipitation time of 61 minutes yielded cubic shaped grains of 0.74 μm in edgelength size. The emulsion was then washed using an ultrafiltration unit, and its final pH and pCl were adjusted to 5.5 and 1.8, respectively.

Emulsion W (Invention)

This emulsion demonstrates the conventional, cubic grain emulsion precipitated in oxidized gelatin and containing 0.3 mole percent of added iodide.

A pure chloride silver halide emulsion was precipitated by equimolar addition of silver nitrate and sodium chloride solution into a well-stirred reactor containing low methionine gelatin peptizer. Silver nitrate solution contained 0.08 mg mercuric chloride based on silver. After 93 mole percent of total silver was precipitated 500 mL of solution containing potassium iodide in an amount corresponding to 0.3 mole percent of total silver precipitated was dumped to the reactor. Total precipitation time of 61 minutes yielded cubic shaped grains of 0.74 μm in edgelength size. The emulsion was then washed using an ultrafiltration unit, and its final pH and pCl were adjusted to 5.5 and 1.8, respectively.

Emulsion AA

This emulsion demonstrates the conventional, small grain cubic emulsion precipitated in non-oxidized gelatin and containing no intentionally added iodide.

A pure chloride silver halide emulsion was precipitated in a manner similar as Emulsion Q, except no iodide was added and precipitation time was shortened in order to obtain cubic grains of 0.4 μm in edgelength size. The emulsion was then washed using an ultrafiltration unit, and its final pH and pCl were adjusted to 5.5 and 1.8, respectively.

Emulsion AB (Invention)

This emulsion demonstrates the conventional, small grain cubic emulsion precipitated in non-oxidized gelatin and containing 0.3 mole percent of added iodide.

A pure chloride silver halide emulsion was precipitated in a manner identical as Emulsion AA, except that after 93 mole percent of total silver was precipitated 500 mL of solution containing potassium iodide in an amount corresponding to 0.5 mole percent of total silver precipitated was dumped to the reactor. Cubic grains of 0.4 μm in edgelength size were obtained. The emulsion was then washed using an ultrafiltration unit, and its final pH and pCl were adjusted to 5.5 and 1.8, respectively.

Emulsion AC

This emulsion demonstrates the conventional, small grain cubic emulsion precipitated in non-oxidized gelatin and containing small amounts of dicesium pentachloronitrosyl osmate for contrast control and no intentionally added iodide.

A pure chloride silver halide emulsion was precipitated in a manner identical as Emulsion AA, except that small amounts of dicesium pentachloronitrosyl osmate was added during precipitation. Cubic grains of 0.4 μm in edgelength size were obtained. The emulsion was then washed using an ultrafiltration unit, and its final pH and pCl were adjusted to 5.5 and 1.8, respectively.

Emulsion AD (Invention)

This emulsion demonstrates the conventional, small grain cubic emulsion precipitated in non-oxidized gelatin and containing small amounts of dicesium pentachloronitrosyl osmate for contrast control and 0.5 mole percent added iodide.

A pure chloride silver halide emulsion was precipitated in a manner identical as Emulsion AA, except that small amounts of dicesium pentachloronitrosyl osmate was added during precipitation. After 93 mole percent of total silver was precipitated 500 mL of solution containing potassium iodide in an amount corresponding to 0.5 mole percent of total silver precipitated was dumped to the reactor. Cubic grains of 0.4 μm in edgelength size were obtained. The emulsion was then washed using an ultrafiltration unit, and its final pH and pCl were adjusted to 5.5 and 1.8, respectively.

SENSITIZATION OF EMULSIONS

The emulsions were each optimally sensitized by the customary techniques using two basic sensitization schemes. The sequence of chemical sensitizers, spectral sensitizers, soluble bromide and antifoggants addition varied depending on particular emulsion being sensitized. There were, however, two significantly different sensitization classes: customary sulfur-plus-gold and high gold. Detailed procedures are described in the Examples below.

In blue-sensitized emulsions the following blue sensitizing dye was used:

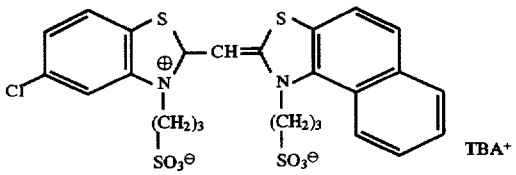

Dye SS-1

Just prior to coating on resin coated paper support blue sensitized emulsions were dual-mixed with yellow dye forming coupler:

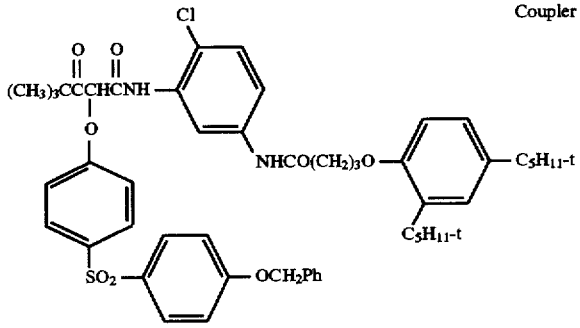

Coupler 1

In red-sensitized emulsions the following red sensitizing dye was used:

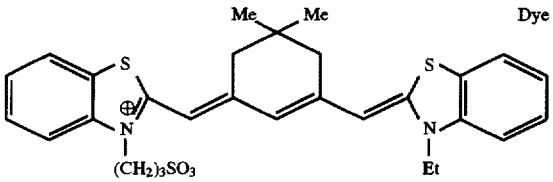

Dye SS-2

Just prior to coating on resin coated paper support red sensitized emulsions were dual-mixed with cyan dye forming coupler:

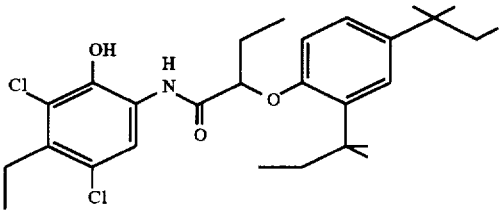

Coupler 2

PHOTOGRAPHIC COMPARISONS

Blue-sensitized emulsions were coated at 26 mg per square foot and Coupler 1 at 100 mg per square foot. The coatings were overcoated with gelatin layer and the entire coating was haredened with bis(vinylsulfonylmethyl)ether.

Coatings were exposed through a step wedge with 3000°K tungsten source at high-intensity short exposure times ($10^{-4}$ or $10^{-5}$ second) or low-intensity, long exposure time of $10^{-2}$ second. The total energy of each exposure was kept at a constant level. Speed is reported as relative log speed at specified level above the minimum density as presented in the following Examples. In relative log speed units a speed difference of 30, for example, is a differenceof 0.30 log E, where E is exposure in lux-seconds. These exposures will be referred to as "Optical Sensitivity" in the following Examples.

Coatings were also exposed with blue and red laser exposing device. Blue-sensitized elements were exposed with a blue Argon Ion (multiline) apparatus at 476.5 nm at a resolution of 196.8 pixels/cm and a pixel pitch of 50.8 μm, and the exposure time of 0.477 microsecond per pixel. Red-sensitized elements were exposed with a red Toshiba TOLD 9140™ exposure apparatus at 685 nm, a resolution of 176.8 pixels/cm, a pixel pitch of 50.8 μm, and the exposure time of 0.05 microsecond per pixel. These exposures will be referred to as "Digital Sensitivity" in the following Examples.

All coatings were processes in Kodak™ Ektacolor RA-4 processing. Relative speeds were reported at Dmin+1.15 and Dmin+1.75 density levels.

COMPARATIVE EXAMPLE 1

This example compares silver chloride {100} tabular emulsions precipitated with and without iodide dumps and sensitized with "high gold" and "sulfur-plus-gold" chemical sensitizations for blue color record. The sensitization details were as follows:

Part 1.1: A portion of tabular silver chloride Emulsion A was optimally sensitized by addition of 580 mg/silver mole of sensitizing dye SS-1, holding the emulsion for 20 minutes, adding optimum amount of sodium thiosulfate pentahydrate and potassium tetrachloroaurate followed by a heat treatment at 60° C. for 40 minutes. The emulsion was then cooled to 40° C. as quickly as possible and 90 mg/silver mole mole of 1-(3-acetomidophenyl)-5-mercaptotetrazole was added.

Part 1.2: A portion of tabular silver chloride Emulsion B was sensitized identically as in Part 1.1.

Part 1.3: A portion of tabular silver chloride Emulsion C was sensitized identically as in Part 1.1.

Part 1.4: A portion of tabular silver chloride Emulsion A was sensitized identically as in Part 1, except that optimum amount of colloidal dispersion of gold sulfide was used instead of sodium thiosulfate pentahydrate and potassium tetrachloroaurate.

Part 1.5: A portion of tabular silver chloride Emulsion B was sensitized identically as in Part 1.4.

Part 1.6: A portion of tabular silver chloride Emulsion C was sensitized identically as in Part 1.4.

Part 1.7: A portion of tabular silver chloride Emulsion D was sensitized identically as in Part 1.4.

Part 1.8: A portion of tabular silver chloride Emulsion E was sensitized identically as in Part 1.4.

Sensitometric data are summarized in Table I.

TABLE I

| | | Optical Sensitivity | | | | | |
|---|---|---|---|---|---|---|---|
| | | $10^{-2}$ sec exposure | | $10^{-5}$ sec exposure | | Sensitivity Change | |
| Emulsion | Finish | Dmin + 0.15 | Dmin + 0.75 | Dmin + 0.15 | Dmin + 0.75 | Dmin + 0.15 | Dmin + 0.75 |
| Part 1.1 | X + S | 156 | 100 | 124 | 35 | −32 | −65 |
| Part 1.2 | X + S | 162 | 102 | 138 | 42 | −24 | −60 |
| Part 1.3 | X + S | 171 | 123 | 160 | 85 | −11 | −38 |
| Part 1.4 | $Au_2S$ | 163 | 116 | 161 | 105 | −2 | −11 |
| Part 1.5 | $Au_2S$ | 169 | 122 | 165 | 107 | −4 | −15 |
| Part 1.6 | $Au_2S$ | 145 | 99 | 137 | 79 | −8 | −20 |
| Part 1.7 | $Au_2S$ | 198 | 111 | 194 | 93 | −4 | −18 |
| Part 1.8 | $Au_2S$ | 197 | 105 | 196 | 91 | −1 | −14 |

Sulfur-plus-gold sensitized <100> tabular emulsions exhibit some beneficial effect of iodide incorporation into the grain. Large losses of speed at short exposure times ($10^{-5}$ second) are somewhat improved. High gold sensitization, despite some non-linearities, in general is better than gold-plus-sulfur (X+S), but it failed to show improvements derived from iodide incorporation into the grains. This effect is especially significant at the mid-scale region of sensitometric curve (at densities 0.75 above Dmin), where human eye is most sensitive to density changes.

EXAMPLE 2

This example shows preferred mode and levels of iodide incorporation into cubic silver chloride emulsions of this invention in blue color record. The sensitization details were as follows:

Part 2.1: A portion of silver chloride Emulsion F was optimally sensitized by addition of 300 mg/silver mole of sensitizing dye SS-1, holding the emulsion for 20 minutes, adding optimum amount of colloidal dispersion of gold sulfide followed by a heat treatment at 60° C. for 40 minutes. The emulsion was then cooled to 40° C. as quickly as possible and 120 mg/silver mole mole of 1-(3-acetomidophenyl)-5-mercaptotetrazole was added.

Part 2.2: A portion of silver chloride Emulsion G was optimally sensitized by addition of 350 mg/silver mole of sensitizing dye SS-1, holding the emulsion for 20 minutes, adding optimum amount of colloidal dispersion of gold sulfide followed by a heat treatment at 60° C. for 40 minutes. The emulsion was then cooled to 40° C. as quickly as possible and 120 mg/silver mole mole of 1-(3-acetomidophenyl)-5-mercaptotetrazole was added.

Part 2.3: A portion of silver chloride Emulsion I was optimally sensitized identically as Part 2.2.

Part 2.4: A portion of silver chloride Emulsion J was optimally sensitized identically as Part 2.2.

Part 2.5: A portion of silver chloride Emulsion K was optimally sensitized identically as Part 2.2.

Part 2.6: A portion of silver chloride Emulsion L was optimally sensitized identically as Part 2.2.

Part 2.7: A portion of silver chloride Emulsion M was optimally sensitized identically as Part 2.2.

Part 2.8: A portion of silver chloride Emulsion N was optimally sensitized identically as Part 2.2.

Part 2.9: A portion of silver chloride Emulsion o was optimally sensitized identically as Part 2.2.

Part 2.10: A portion of silver chloride Emulsion P was optimally sensitized identically as Part 2.2.

Sensitometric data are summarized in Table II.

TABLE II

| | Optical Sensitivity | | | | | |
|---|---|---|---|---|---|---|
| | $10^{-2}$ sec exposure | | $10^{-5}$ sec exposure | | Sensitivity Change | |
| Emulsion | Dmin + 0.15 | Dmin + 1.15 | Dmin + 0.15 | Dmin + 1.15 | Dmin + 0.15 | Dmin + 1.15 |
| Part 2.1 (comp.) | 156 | 100 | 148 | 74 | −8 | −26 |
| Part 2.2 (comp.) | 165 | 105 | 148 | 67 | −17 | −38 |
| Part 2.3 (inven.) | 173 | 109 | 172 | 103 | −1 | −6 |
| Part 2.4 (inven.) | 173 | 108 | 168 | 100 | −5 | −8 |
| Part 2.5 (inven.) | 194 | 130 | 198 | 131 | +4 | +1 |
| Part 2.6 (inven.) | 186 | 122 | 180 | 110 | −6 | −12 |
| Part 2.7 (inven.) | 198 | 131 | 196 | 127 | −2 | −4 |
| Part 2.8 (inven.) | 156 | 104 | 158 | 89 | +2 | −15 |
| Part 2.9 (inven.) | 162 | 104 | 153 | 84 | −9 | −20 |
| Part 2.10 (inven.) | 180 | 125 | 171 | 105 | −9 | −20 |

Preferred amount of iodide is any amount larger than zero with amounts larger than 0.2% are more preferred. Preferred addition is after 50% of silver chloride has been precipitated with more preferred location at 90 to 100% of the make. Preferred addition of iodide is any effective addition with quick "dumps" more preferred.

EXAMPLE 3

This example shows preferred chemical sensitization of the emulsions of this invention for digital imaging in blue color record. The sensitization details were as follows:

Part 3.1: A portion of silver chloride Emulsion T was optimally sensitized by addition of 300 mg/silver mole of sensitizing dye SS-1, holding the emulsion for 20 minutes, adding 2 mg/silver mole of potassium tetrachloroaurate and 2 mg/silver mole of sodium thiosulfate pentahydrate followed by a heat treatment at 60° C. for 40 minutes. The emulsion was then cooled to 40° C. as quickly as possible and 100 mg/silver mole mole of 1-(3-acetomidophenyl)-5-mercaptotetrazole was added.

Part 3.2: A portion of silver chloride Emulsion W was optimally sensitized identically as Part 3.1.

Part 3.3: A portion of silver chloride Emulsion T was optimally sensitized by addition of 300 mg/silver mole of sensitizing dye SS-1, holding the emulsion for 20 minutes, adding 0.8 mg/silver mole of gold sulfide (in colloidal gelatin dispersion) and 1 mg/silver mole of sodium thiosulfate pentahydrate followed by a heat treatment at 60° C. for 40 minutes. The emulsion was then cooled to 40° C. as quickly as possible and 100 mg/silver mole mole of 1-(3-acetomidophenyl)-5-mercaptotetrazole was added.

Part 3.4: A portion of silver chloride Emulsion W was optimally sensitized identically as Part 3.3.

Sensitometric data are summarized in Table III.

TABLE III

| | | Optical Sensitivity | | | | Digital Sensitivity | |
|---|---|---|---|---|---|---|---|
| | | $10^{-2}$ sec exposure | | $10^{-5}$ sec exposure | | $4.77 \times 10^{-7}$ sec exposure | |
| Emulsion | Finish | Dmin + 0.15 | Dmin + 1.35 | Dmin + 0.15 | Dmin + 1.35 | Dmin + 1.15 | Dmin + 1.75 |
| Part 3.1 (comp.) | X + S | 180 | 100 | 100 | — | 100 | 76 |
| Part 3.2 | X + S | 201 | 136 | 199 | 111 | 153 | 122 |

TABLE III-continued

| | | Optical Sensitivity | | | | Digital Sensitivity | |
|---|---|---|---|---|---|---|---|
| | | $10^{-2}$ sec exposure | | $10^{-5}$ sec exposure | | $4.77 \times 10^{-7}$ sec exposure | |
| Emulsion | Finish | Dmin + 0.15 | Dmin + 1.35 | Dmin + 0.15 | Dmin + 1.35 | Dmin + 1.15 | Dmin + 1.75 |
| (comp.) Part 3.3 (comp.) | $Au_2S$ | 233 | 163 | 216 | 96 | 153 | 126 |
| Part 3.4 (inven.) | $Au_2S$ | 249 | 171 | 247 | 154 | 184 | 158 |

Sulfur-plus-gold sensitized cubic emulsions exhibit large effects of iodide incorporation on both reciprocity and speed from laser exposures, especially at mid-scale and shoulder portion of sensitometric curve (at densities 1.75 above Dmin). High speed generated by laser exposures at higher densities is especially important in digital imaging. Unlike <100> tabular grain emulsions, however, the maximum effect is obtained when a source of gold is gold sulfide, and the amount of sulfur compound used is reduced (including cases with no intentionally added sulfur compounds). The last three columns of Table III are most important for illustrating the invention, as the short exposure times are of most interest.

EXAMPLE 4

This example shows preferred levels of chemical sensitizers of the emulsion of this invention for digital imaging in blue color record. The sensitization details were as follows:

Part 4.1: A portion of silver chloride Emulsion U was optimally sensitized by addition of 300 mg/silver mole of sensitizing dye SS-1, holding the emulsion for 20 minutes, adding 0.8 mg/silver mole of colloidal gold sulfide followed by a heat treatment at 60° C. for 40 minutes. The emulsion was then cooled to 40° C. as quickly as possible and 100 mg/silver mole mole of 1-(3-acetomidophenyl)-5-mercaptotetrazole was added.

Part 4.2: A portion of silver chloride Emulsion U was optimally sensitized identically as Part 4.1, except that after gold sulfide, 0.2 mg/silver mole of sodium thiosulfate pentahydrate was added.

Part 4.3: A portion of silver chloride Emulsion U was optimally sensitized by addition of 300 mg/silver mole of sensitizing dye SS-1, holding the emulsion for 20 minutes, adding 2 mg/silver mole of potassium tetrachloroaurate followed by a heat treatment at 60° C. for 40 minutes. The emulsion was then cooled to 40° C. as quickly as possible and 100 mg/silver mole mole of 1-(3-acetomidophenyl)-5-mercaptotetrazole was added.

Part 4.4: A portion of silver chloride Emulsion U was optimally sensitized identically as Part 4.3, except that 0.2 mg/silver mole of sodium thiosulfate pentahydrate was added after gold sensitizer.

Part 4.5: A portion of silver chloride Emulsion U was optimally sensitized identically as Part 4.3, except that 0.6 mg/silver mole of sodium thiosulfate pentahydrate was added after gold sensitizer.

Part 4.6: A portion of silver chloride Emulsion U was optimally sensitized identically as Part 4.3, except that 1.0 mg/silver mole of sodium thiosulfate pentahydrate was added after gold sensitizer.

Part 4.7: A portion of silver chloride Emulsion U was optimally sensitized identically as Part 4.3, except that 2.0 mg/silver.mole of sodium thiosulfate pentahydrate was added after gold sensitizer.

Part 4.8: A portion of silver chloride Emulsion U was optimally sensitized identically as Part 4.3, except that 4.0 mg/silver mole of sodium thiosulfate pentahydrate was added after gold sensitizer.

Sensitometric data are summarized in Table IV.

TABLE IV

| | Optical Sensitivity | | | | Digital Sensitivity | |
|---|---|---|---|---|---|---|
| | $10^{-2}$ sec exposure | | $10^{-5}$ sec exposure | | $4.77 \times 10^{-7}$ sec exposure | |
| Emulsion | Dmin + 0.15 | Dmin + 1.35 | Dmin + 0.15 | Dmin + 1.35 | Dmin + 1.15 | Dmin + 1.75 |
| Part 4.1 (inven.) | 161 | 100 | 157 | 86 | 100 | 80 |
| Part 4.2 (inven.) | 171 | 105 | 165 | 88 | 103 | 82 |
| Part 4.3 (comp.) | 145 | 25 | 131 | — | 20 | — |
| Part 4.4 (inven.) | 173 | 91 | 164 | 65 | 85 | 53 |
| Part 4.5 (comp.) | 139 | 85 | 134 | 68 | 85 | 64 |
| Part 4.6 (comp.) | 125 | 75 | 122 | 58 | 76 | 55 |
| Part 4.7 (comp.) | 126 | 58 | 121 | 24 | 63 | 25 |
| Part 4.8 (comp.) | 106 | — | 105 | — | 13 | — |

It is clear from the data in Table IV that the amount of sulfur is preferably less than 0.6 mg of sodium thiosulfate pentahydrate per mole of silver with more preferred amont less than 0.2 mg of sodium thiosulfate pentahydrate per mole of silver.

EXAMPLE 5

This example shows the advantage of the emulsion of this invention over the alternative speed increase achieved by increasing the grain size of silver chloride emulsion not containing any intentionally added iodide for digital imaging in blue color record. The sensitization details were as follows:

Part 5.1: A portion of silver chloride Emulsion R was optimally sensitized by addition of optimum amount of colloidal gold sulfide followed by heat ramp up to 60° C. and subsequent addition of sensitizing dye SS-1, 1-(3-acetomidophenyl)-5-mercaptotetrazole, and 0.5 % of potassium bromide. The emulsion was then cooled to 40° C. as quickly as possible.

Part 5.2: A portion of silver chloride Emulsion Q was optimally sensitized as Part 1, except that potassium bromide was omitted.

Sensitometric data are summarized in Table V.

TABLE V

| | Optical Sensitivity | | | | Digital Sensitivity | |
|---|---|---|---|---|---|---|
| | $10^{-2}$ sec exposure | | $10^{-5}$ sec exposure | | $4.77 \times 10^{-7}$ sec exposure | |
| Emulsion | Dmin + 0.15 | Dmin + 1.15 | Dmin + 0.15 | Dmin + 1.15 | Dmin + 1.15 | Dmin + 1.75 |
| Part 5.1 (comp.) | 145 | 100 | 107 | 32 | 100 | 70 |
| Part 5.2 (inven.) | 143 | 92 | 146 | 88 | 117 | 81 |

Large grain comparative emulsion (1 μm edgelength size) suffers from high intensity reciprocity failure and is much slower at digital exposures than emulsion of this invention containing 0.3 mole percent iodide (0.75 μm edgelength size). Increasing grain size and sensitizing optimally with the use of potassium bromide was not as good as incorporating iodide and optimally sensitizing with no potassium bromide.

EXAMPLE 6

This example shows the advantage of emulsions of this invention for emulsions of smaller grain size sensitized for digital imaging in red color record. The sensitization details were as follows:

Part 6.1: A portion of silver chloride Emulsion AA was optimally sensitized by addition of optimum amount of colloidal gold sulfide followed by heat ramp up to 60° C. for 40 minutes. Then emulsion was cooled down to 40° C. and 1, 1-(3-acetomidophenyl)-5-mercapto-tetrazole was added followed by addition of potassium bromide and SS-2 sensitizing dye.

Part 6.2: A portion of silver chloride Emulsion AB was optimally sensitized identically as Part 6.1.

Part 6.3: A portion of silver chloride Emulsion AC was optimally sensitized identically as Part 6.1.

Part 6.4: A portion of silver chloride Emulsion AD was optimally sensitized identically as Part 6.1.

Sensitometric data are summarized in Table VI.

TABLE VI

| | Optical Sensitivity | | | | Digital Sensitivity | |
|---|---|---|---|---|---|---|
| | $10^{-2}$ sec exposure | | $10^{-5}$ sec exposure | | $4.77 \times 10^{-7}$ sec exposure | |
| Emulsion | Dmin + 0.15 | Dmin + 1.35 | Dmin + 0.15 | Dmin + 1.35 | Dmin + 1.15 | Dmin + 1.75 |
| Part 6.1 (comp.) | 147 | 100 | 148 | 77 | 100 | 63 |
| Part 6.2 (inven.) | 202 | 124 | 193 | 103 | 116 | 77 |
| Part 6.3 (comp.) | 140 | 93 | 134 | 77 | 95 | 63 |
| Part 6.4 (inven.) | 179 | 116 | 173 | 99 | 109 | 75 |

As can be clearly seen from the table speed at both short time optical and digital exposures is improved with the emulsion of this invention containing iodide, even when a contrast increasing dopant is used.

EXAMPLE 7

This example shows the advantage of emulsion of this invention over the alternative equal grain size cubic silver chloride emulsion doped with an iridium compound and used for blue record of a multilayer color paper. The sensitization details and multilayer composition were as follows:

Part 7.1: A portion of silver chloride Emulsion S was optimally sensitized by addition of optimum amount of colloidal gold sulfide followed by heat ramp up to 60° C. and subsequent addition of sensitizing dye SS-1, 1-(3-acetomidophenyl)-5-mercaptotetrazole, small amount of potassium hexachloroiridate, and potassium bromide. The emulsion was then cooled to 40° C. as quickly as possible.

Part 7.2: A portion of silver chloride Emulsion V was optimally sensitized by addition of 300 mg/silver mole of sensitizing dye SS-1, holding the emulsion for 20 minutes, adding 0.8 mg/silver mole of colloidal gold sulfide followed by a heat treatment at 60° C. for 40 minutes. The emulsion was then cooled to 40° C. as quickly as possible and 100 mg/silver mole mole of 1-(3-acetomidophenyl)-5-mercaptotetrazole was added.

These emulsions were used as a blue record of a color paper multilayer, as described, e.g., in *Research Disclosure*, Vol 362, Item 362116, Page 291. Briefly, the two emulsions were mixed with a dispersion of Coupler-1 and coated as the bottom layers in multicolor element on resin coated paper. The element contained the following layers, starting from the top: gelatin overcoat, red-sensitive layer containing silver chloride cubic emulsion and cyan coupler, gelatin interlayer, green-sensitive layer containg silver chloride cubic emulsion and magenta coupler, interlayer containing 105 mg/ft$^2$ (1130 mg/m$^2$) of gelatin, blue-sensitive layer containg emulsion of this invention and comparative emulsion and yellow coupler. Each of the blue layers contained 26 mg/ft$^2$ (280 mg/m$^2$) of silver, 100 mg/ft$^2$ (1080 mg/m$^2$) of Coupler-1, and 74 mg/ft$^2$ (800 mg/m$^2$) of gelatin. Sensitometric data are summarized in Table VII.

TABLE VII

| | Optical Sensitivity | | | | Digital Sensitivity | |
|---|---|---|---|---|---|---|
| | $10^{-2}$ sec exposure | | $10^{-5}$ sec exposure | | $4.77 \times 10^{-7}$ sec exposure | |
| Emulsion | Dmin + 0.15 | Dmin + 1.15 | Dmin + 0.15 | Dmin + 1.15 | Dmin + 1.15 | Dmin + 1.75 |
| Part 7.1 (comp.) | 153 | 100 | 147 | — | 100 | 46 |
| Part 7.2 (inven.) | 192 | 136 | 178 | 98 | 138 | 111 |

Silver chloride emulsion 7.2 of this invention containing 0.2 mole percent iodide provides additional efficiency over similar grain size conventional emulsion in multicolor element designed for digital exposures.

EXAMPLE 8

This example demonstrates a color paper designed for digital exposures in which all three color recording emulsions contain intentionally added iodide.

Silver chloride emulsions were chemically and spectrally sensitized as is described below.

Blue Sensitive Emulsion (Blue EM-1, prepared similarly to that described in U.S. Pat. No 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. After 93 mole percent of total silver was precipitated 500 mL of solution containing potassium iodide in an amount corresponding to 0.3 mole percent of total silver precipitated was dumped into the reactor. $Cs_2Os(NO)Cl_5$ dopant was added during the silver halide grain formation for most of the precipitation, followed by a shelling without dopant. The resultant emulsion contained cubic shaped grains of 0.76 μm in edgelength size. This emulsion was optimally sensitized by the addition of a colloidal suspension of aurous sulfide and heat ramped up to 60° C. during which time blue sensitizing dye BSD-4 1-(3-acetamidophenyl)-5-mercaptotetrazole and potassium bromide were added. In addition, iridium dopant was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. After 93 mole percent of total silver was precipitated 500 mL of solution containing potassium iodide in an amount corresponding to 0.3 mole percent of total silver precipitated was dumped into the reactor. $Cs_2Os(NO)Cl_5$ dopant was added during the silver halide grain formation for most of the precipitation, followed by a shelling without dopant. The resultant emulsion contained cubic shaped grains of 0.30 μm in edgelength size. This emulsion was optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1, and 1-(3-acetamidophenyl)-5-mercaptotetrazole.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. After 93 mole percent of total silver was precipitated 500 mL of solution containing potassium iodide in an amount corresponding to 0.3 mole percent of total silver precipitated was dumped into the reactor. The resultant emulsion contained cubic shaped grains of 0.40 μm in edgelength size. This emulsion was optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium and ruthenium dopants were added during the sensitization process.

Coupler dispersions were emulsified by methods well known to the art, and the following layers were coated on a polyethylene resin coated paper support, that was sized as described in U.S. Pat. No. 4,994,147 and pH adjusted as described in U.S. Pat. No. 4,917,994. The polyethylene layer coated on the emulsion side of the support contained a mixture of 0.1 % (4,4'-bis(5-methyl-2-benzoxazolyl) stilbene and 4,4'-bis(2-benzoxazolyl) stilbene, 12.5% $TiO_2$, and 3% ZnO white pigment. The layers were hardened with bis(vinylsulfonyl methyl) ether at 1.95% of the total gelatin weight.

| Layer 1: Blue Sensitive Layer | |
|---|---|
| Gelatin | 1.528 g/m$^2$ |
| Blue Sensitive Silver (Blue EM-1) | 0.253 g Ag/m$^2$ |
| Y-4 | 0.484 g/m$^2$ |
| Dibutyl phthalate | 0.330 g/m$^2$ |
| N-tert-butylacrylamide/ 2-acrylamido-2-methylpropane sulfonic acid sodium salt (99/1 ratio mixture) | 0.484 g/m$^2$ |
| 2,5-Dihydroxy-5-methyl-3-(1-piperidinyl)-2-cyclopenten-1-one | 0.002 g/m$^2$ |
| ST-16 | 0.009 g/m$^2$ |
| KCl | 0.020 g/m$^2$ |
| DYE-1 | 0.009 g/m$^2$ |

-continued

| | |
|---|---|
| Layer 2: Interlayer | |
| Gelatin | 0.753 g/m$^2$ |
| Dioctyl hydroquinone | 0.108 g/m$^2$ |
| Dibutyl phthalate | 0.308 g/m$^2$ |
| Disodium 4,5 Dihydroxy-in-benzenedisulfonate | 0.065 g/m$^2$ |
| SF-1 | 0.011 g/m$^2$ |
| Irganox 1076 ™ | 0.016 g/m$^2$ |
| Layer 3: Green Sensitive Layer | |
| Gelatin | 1.270 g/m$^2$ |
| Green Sensitive Silver (Green EM-1) | 0.212 g Ag/m$^2$ |
| M-1 | 0.423 g/m$^2$ |
| Tris (2-ethylhexyl) phosphate | 0.409 g/m$^2$ |
| 2-(2-butoxyethoxy) ethyl acetate | 0.069 g/m$^2$ |
| ST-2 | 0.327 g/m$^2$ |
| Dioctyl hydroquinone | 0.042 g/m$^2$ |
| 1-(3-Benzamidophenyl)-5-mercaptotetrazole | 0.001 g/m$^2$ |
| DYE-2 | 0.006 g/m$^2$ |
| KCl | 0.020 g/m$^2$ |
| Layer 4: UV Interlayer | |
| Gelatin | 0.822 g/m$^2$ |
| UV-1 | 0.060 g/m$^2$ |
| UV-2 | 0.342 g/m$^2$ |
| Dioctyl hydroquinone | 0.082 g/m$^2$ |
| 1,4-Cyclohexylenedimethylene bis (2-ethylhexanoate) | 0.15 7 g/m$^2$ |
| Layer 5: Red Sensitive Layer | |
| Gelatin | 1.389 g/m$^2$ |
| Red Sensitive Silver (Red EM-1) | 0.187 g Ag/m$^2$ |
| C-3 | 0.423 g/m$^2$ |
| Dibutyl phthalate | 0.415 g/m$^2$ |
| UV-2 | 0.272 g/m$^2$ |
| 2-(2-butoxyethoxy) ethyl acetate | 0.035 g/m$^2$ |
| Dioctyl hydroquinone | 0.005 g/m$^2$ |
| Potassium tolylthiosulfonate | 0.003 g/m$^2$ |
| Potassium tolylsulfinate | 0.0003 g/m$^2$ |

-continued

| | |
|---|---|
| Silver phenylmercaptotetrazole | 0.0009 g/m$^2$ |
| DYE-3 | 0.023 g/m$^2$ |
| Layer 6: UV Overcoat | |
| Gelatin | 0.382 g/m$^2$ |
| UV-1 | 0.028 g/m$^2$ |
| UV-2 | 0.159 g/m$^2$ |
| Dioctyl hydroquinone | 0.038 g/m$^2$ |
| 1,4-Cyclohexylenedimethylene bis (2-ethylhexanoate) | 0.073 g/m$^2$ |
| Layer 7: SOC | |
| Gelatin | 1.076 g/m$^2$ |
| Polydimethylsiloxane | 0.027 g/m$^2$ |
| SF-1 | 0.009 g/m$^2$ |
| SF-2 | 0.0026 g/m$^2$ |
| SF-12 | 0.004 g/m$^2$ |
| Tergitol 15-S-5 ™ | 0.003 g/m$^2$ |

The green layer of the multilayer formulation is modified in the following manner:

| Layer 3: Green Sensitive Layer | |
|---|---|
| Gelatin | 1.259 g/m$^2$ |
| Green Sensitive Silver (Green EM-1) | 0.145 g Ag/m$^2$ |
| M-2 | 0.258 g/m$^2$ |
| Tris (2-ethylhexyl) phosphate | 0.620 g/m$^2$ |
| ST-5 | 0.599 g/m$^2$ |
| ST-21 | 0.150 g/m$^2$ |
| Dioctyl hydroquinone | 0.095 g/m$^2$ |
| HBAPMT | 0.001 g/m$^2$ |
| KCl | 0.020 g/m$^2$ |
| BIO-1 | 0.010 mg/m$^2$ |
| DYE-2 | 0.006 g/m$^2$ |

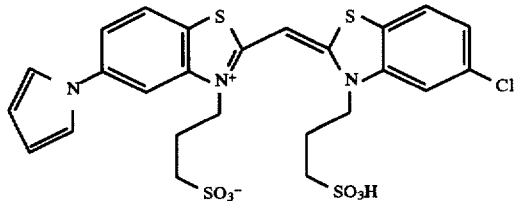

BSD-4

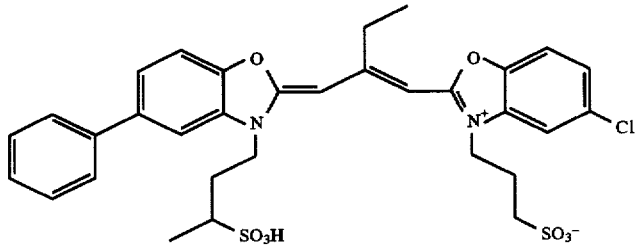

GSD-1

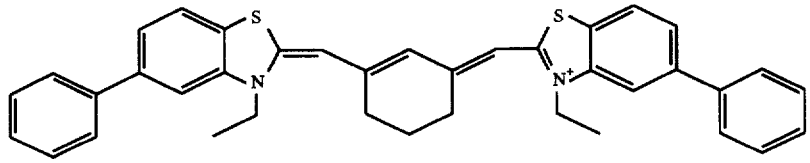

RSD-1

-continued
Y-4
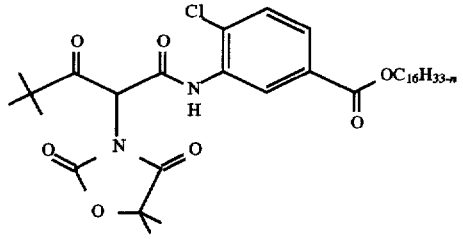
M-1
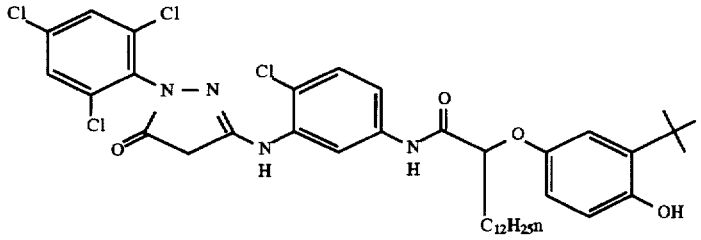
M-2
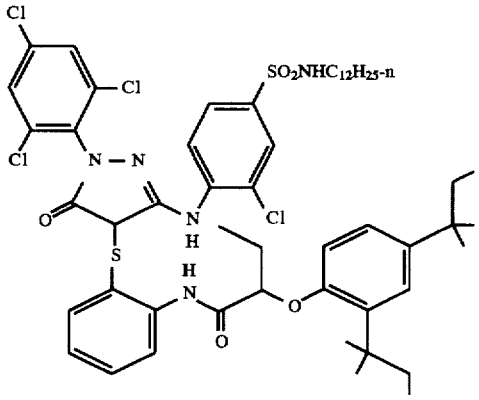
C-1
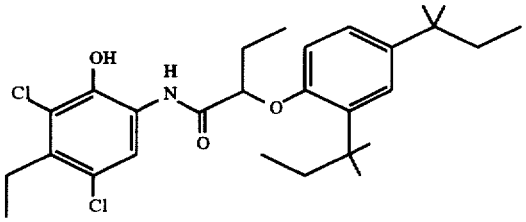
ST-2
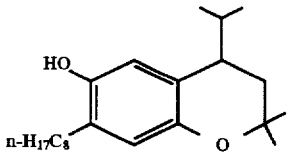
ST-5
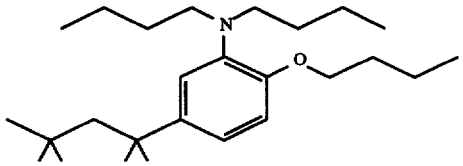
ST-16
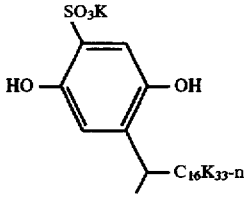

-continued
ST-21
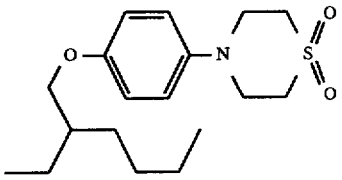
DYE-1
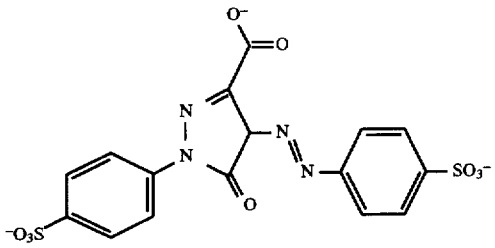
DYE-2
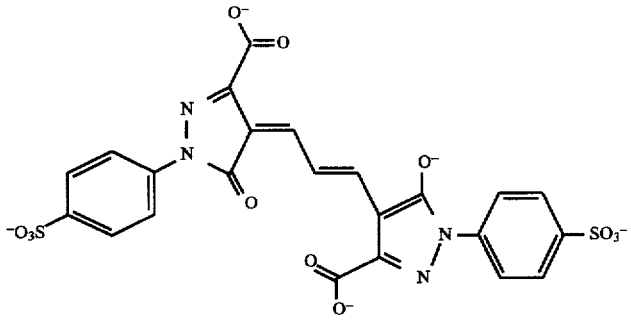
DYE-3
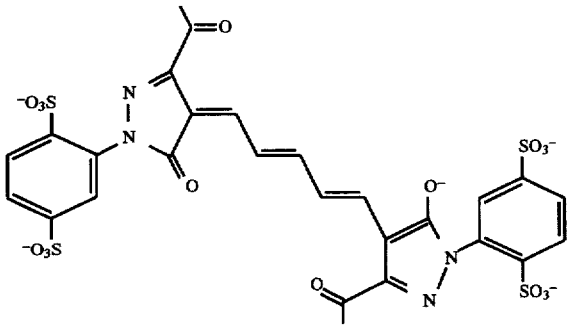
UV-1
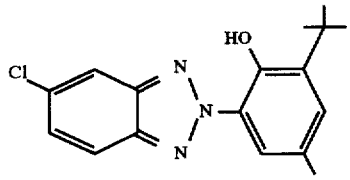
UV-2
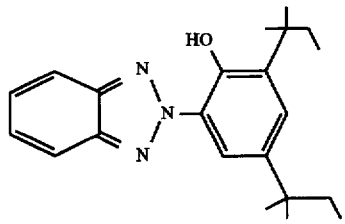

-continued

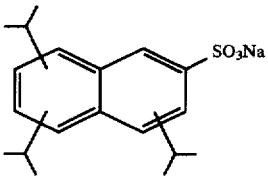

SF-1

$CF_3(CF_2)_7SO_3Na$

SF-2

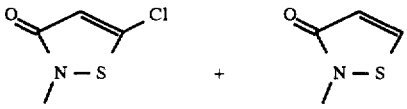

SF-12

BIO-1

Reciprocity characteristics and overall performance of this paper when exposed by laser was excellent.

The invention has been described in detail with particular reference to preferred embodiments thereof, but it will be understood that variations and modifications can be effected within the spirit and scope of the invention.

We claim:

1. A method of imaging providing a photographic element for digital exposure comprising at least one layer comprising an emulsion of cubic silver iodochloride grain wherein said grain has been sensitized with a gold compound and with less than 1 μmole per silver mole of sulfur, wherein said iodochloride grain comprises between 0.1 and 1 mole percent iodide and wherein the iodide of said iodochloride grain is present in the outer 15 percent by mass of the grains of the emulsion, and subjecting said element to digital exposure wherein said gold compound comprises 0.10 to 100 milligrams of gold sulfide per mole of silver.

2. The method of claim 1 wherein sulfur is present in an amount of less than 0.5 μmole per silver mole.

3. The method of claim 1 wherein said digital exposure comprises actinic radiation of at least $10^{-4}$ erg/cm$^2$ for up to 100 microsecond duration exposure in a pixel-by-pixel mode.

4. The method of claim 2 wherein said sulfur is present in an amount between 0.5 and 0.05 μmole per silver mole.

* * * * *